US010805731B2

(12) United States Patent
Gong et al.

(10) Patent No.: US 10,805,731 B2
(45) Date of Patent: Oct. 13, 2020

(54) METHOD FOR CONTROLLING EARPHONE SWITCHING, EARPHONE, AND EARPHONE SYSTEM

(71) Applicant: Guangdong Oppo Mobile Telecommunications Corp., Ltd., Dongguan, Guangdong (CN)

(72) Inventors: Jinhua Gong, Guangdong (CN); Baoti Li, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 16/459,227

(22) Filed: Jul. 1, 2019

(65) Prior Publication Data

US 2020/0007989 A1 Jan. 2, 2020

(30) Foreign Application Priority Data

Jul. 2, 2018 (CN) ..... 2018 1 0710115

(51) Int. Cl.
*H04R 5/04* (2006.01)
*H04R 1/10* (2006.01)
(Continued)

(52) U.S. Cl.
CPC ..... *H04R 5/04* (2013.01); *H04R 1/1025* (2013.01); *H04R 1/1041* (2013.01); *H04R 3/12* (2013.01); *H04R 5/033* (2013.01); *H04R 2420/07* (2013.01)

(58) Field of Classification Search
None
See application file for complete search history.

(56) References Cited

U.S. PATENT DOCUMENTS

2016/0219358 A1* 7/2016 Shaffer ..... H04R 1/1041
2017/0289668 A1* 10/2017 Kim ..... H04M 1/7253
(Continued)

FOREIGN PATENT DOCUMENTS

CN 103079150 A 5/2013
CN 106937197 A 7/2017
(Continued)

OTHER PUBLICATIONS

International search report issued in corresponding international application No. PCT/CN2019/093112 dated Sep. 2, 2019.
(Continued)

*Primary Examiner* — Kenny H Truong

(57) ABSTRACT

A method for controlling earphone switching, an earphone, and an earphone system are provided. The method is applicable to a first earphone. The method includes the following. Whether the first earphone is put in a charging case is detected, where the first earphone is coupled with a second earphone and an electronic device and serves as a master earphone, and the second earphone serves as a slave earphone. Upon detecting that the first earphone is put in the charging case, the first earphone is switched to serve as the slave earphone and the second earphone is switched to serve as the master earphone. As such, switching between master and slave earphones can be achieved upon detecting that the master earphone is put in the charging case, which is possible to improve user experience.

19 Claims, 7 Drawing Sheets

(51) Int. Cl.
*H04R 3/12* (2006.01)
*H04R 5/033* (2006.01)

(56) References Cited

U.S. PATENT DOCUMENTS

| | | | |
|---|---|---|---|
| 2017/0311105 | A1 | 10/2017 | Hariharan et al. |
| 2018/0064224 | A1 | 3/2018 | Brzezinski et al. |
| 2018/0115816 | A1 | 4/2018 | Panecki et al. |

FOREIGN PATENT DOCUMENTS

| | | | |
|---|---|---|---|
| CN | 206350153 | U | 7/2017 |
| CN | 106998511 | A | 8/2017 |
| CN | 107071618 | A | 8/2017 |
| CN | 107145330 | A | 9/2017 |
| CN | 107708014 | A | 2/2018 |
| CN | 107809696 | A | 3/2018 |
| WO | 2018026201 | A1 | 2/2018 |

OTHER PUBLICATIONS

Extended European search report issued in corresponding European application No. 19183602.2 dated Oct. 22, 2019.

* cited by examiner

METHOD FOR CONTROLLING EARPHONE SWITCHING, EARPHONE, AND EARPHONE SYSTEM

CROSS-REFERENCE TO RELATED APPLICATION(S)

This application claims priority to Chinese Patent Application No. 201810710115.8, filed on Jul. 2, 2018, the disclosure of which is hereby incorporated by reference in its entirety.

TECHNICAL FIELD

This disclosure relates to the field of electronic technology, and more particularly to a method for controlling earphone switching, an earphone, and an earphone system.

BACKGROUND

With the development of wireless technology, a scenario in which wireless earphones are coupled with electronic devices such as mobile phones through wireless technology is becoming increasingly prevalent. Functions such as listening to music, making a call, etc. can be realized with the wireless earphones. However, existing wireless earphones have only simple functions, which provides poor experience for users.

SUMMARY

According to embodiments of the present disclosure, a method for controlling earphone switching, an earphone, and an earphone system are provided, which can achieve switching between master and slave earphones when a master earphone is in a charging case.

In a first aspect of the present disclosure, a method for controlling earphone switching is provided. The method is applicable to a first earphone and includes the following. Whether the first earphone is put in a charging case is detected, where the first earphone is coupled with a second earphone and an electronic device and serves as a master earphone, and the second earphone serves as a slave earphone. Upon detecting that the first earphone is put in the charging case, the first earphone is switched to serve as the slave earphone and the second earphone is switched to serve as the master earphone.

In a second aspect of the present disclosure, an earphone is provided. The earphone serves as a master earphone and is coupled with an electronic device and the other earphone serving as a slave earphone. The earphone includes at least one processor and a computer readable storage. The computer readable storage is coupled to the at least one processor and stores at least one computer executable instruction thereon which, when executed by the at least one processor, is operable with the at least one processor to: detect whether the earphone is put in a charging case; and switch the earphone to serve as the slave earphone and switch the other earphone to serve as the master earphone, upon detecting that the earphone is put in the charging case.

In a third aspect of the present disclosure, an earphone system is provided. The earphone system includes a first earphone and a second earphone with only one of them being capable of coupling with an electronic device at a time. The first earphone is currently coupled with the electronic device and the second earphone. The first earphone includes at least one processor and a computer readable storage. The computer readable storage is coupled to the at least one processor and stores at least one computer executable instruction thereon which, when executed by the at least one processor, is operable with the at least one processor to: detect whether the first earphone is put in a charging case; and disconnect a first data transmission link between the first earphone and the electronic device and establish a second data transmission link between the second earphone and the electronic device, upon detecting that the first earphone is put in the charging case.

BRIEF DESCRIPTION OF THE DRAWINGS

In order to describe technical solutions of embodiments of the present disclosure or the related art more clearly, the following will give a brief description of accompanying drawings used for describing the embodiments of the present disclosure or the related art. Apparently, accompanying drawings described below are merely some embodiments of the present disclosure. Those of ordinary skill in the art can also obtain other accompanying drawings based on the accompanying drawings described below without creative efforts.

DETAILED DESCRIPTION

Figure 1A:
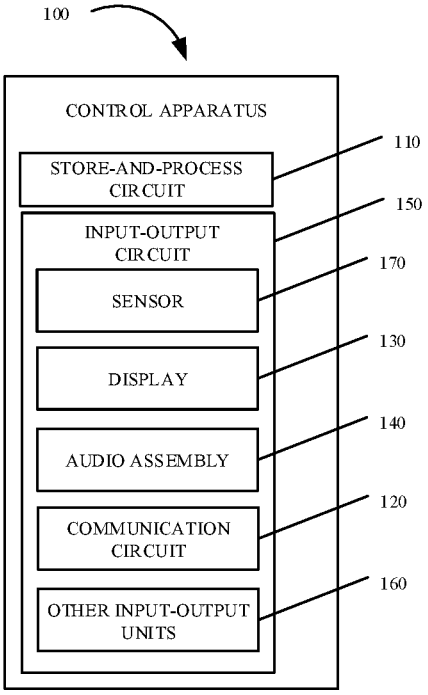
FIG. 1A is a schematic structural diagram illustrating a control apparatus according to an embodiment of the present disclosure.

In order for those skilled in the art to better understand technical solutions of the present disclosure, technical solutions of embodiments of the present disclosure will be described clearly and completely with reference to accompanying drawings in the embodiments of the present disclosure. Apparently, embodiments described hereinafter are merely some embodiments, rather than all embodiments, of the present disclosure. All other embodiments obtained by those of ordinary skill in the art based on the embodiments of the present disclosure without creative efforts shall fall within the protection scope of the present disclosure.

Detailed description will be given below.

The terms "first", "second", "third", "fourth", and the like used in the specification, the claims, and the accompany drawings of the present disclosure are used to distinguish different objects rather than describe a particular order. The terms "include", "comprise", and "have" as well as variations thereof are intended to cover non-exclusive inclusion. For example, a process, method, system, product, or apparatus including a series of steps or units is not limited to the listed steps or units. Instead, it can optionally include other steps or units that are not listed; alternatively, other steps or units inherent to the process, method, product, or apparatus can also be included.

The term "embodiment" referred to herein means that a particular feature, structure, or character described in conjunction with the embodiment may be contained in at least one embodiment of the present disclosure. The phrase appearing in various places in the specification does not necessarily refer to the same embodiment, nor does it refer to an independent or alternative embodiment that is mutually exclusive with other embodiments. It is explicitly and implicitly understood by those skilled in the art that an embodiment described herein may be combined with other embodiments.

An electronic device may include various handheld devices, in-vehicle devices, computing devices that have wireless communication functions or other processing devices connected to the wireless modem, as well as various forms of user equipments (UE), mobile stations (MS), terminal devices, and the like. For the convenience of description, the above-mentioned devices are collectively referred to as the electronic device.

In embodiments of the present disclosure, a first earphone and a second earphone are both wireless earphones and can be taken as a pair of earphones after successful pairing. Communication between the wireless earphone and the electronic device can be conducted through the following technologies: wireless fidelity (Wi-Fi), Bluetooth, visible light communication, invisible light communication (such as infrared communication and ultraviolet communication), and the like. In the embodiments, the first earphone can serve as a master earphone and the second earphone can serve as a slave earphone. A first data transmission link is established between the master earphone and the electronic device, through which data transmission between the wireless earphone and the electronic device is conducted. The slave earphone does not communicate initiatively with the electronic device. Pairing between the master earphone and the slave earphone can be achieved through Bluetooth, to further achieve communication between the master earphone and the slave earphone.

In an example, the wireless earphone can be ear hook earphones, earbuds, or over-ear/on-ear earphones, which is not limited herein.

The wireless earphone can be accommodated in an earphone case. The earphone case can include two receive cavities (i.e., a first receive cavity and a second receive cavity) and one or more magnetic components which are provided in the earphone case. The two receive cavities are designed for receiving a pair of wireless earphones (i.e., a left earphone and a right earphone) both in size and shape. The one or more magnetic components are configured to attract and fix magnetically the pair of wireless earphones in the two receive cavities respectively. The earphone case can further include a cover. In terms of size and shape, the first receive cavity is designed for receiving the first earphone, and the second receive cavity is designed for receiving the second earphone.

The wireless earphone can include an earphone housing, a rechargeable battery (such as a lithium battery) accommodated in the earphone housing, multiple metal contacts for coupling the rechargeable battery with a charging device, and a speaker assembly including a driver unit and a directional voice port. The driver unit includes a magnetic body, a voice coil, and an isolation membrane. The driver unit is configured to make a sound through the directional voice port. The multiple metal contacts are arranged on an outer surface of the earphone housing.

In an example, the wireless earphone further includes a touch area. The touch area is located on the outer surface of the earphone housing. The touch area is provided with at least one touch sensor to detect touch operations. The touch sensor can include a capacitive sensor. When the touch area is touched by a user, at least one capacitive sensor will detect its own change in capacitance, thereby recognizing touch operations.

In an example, the wireless earphone further includes an acceleration sensor and a three-axis gyroscope. The acceleration sensor and the three-axis gyroscope are accommodated in the earphone housing to recognize a pick-up operation and a take-out operation of the wireless earphone.

In an example, the wireless earphone further includes at least one barometric pressure sensor. The barometric pressure sensor is disposed on the outer surface of the earphone housing and is configured to detect barometric pressure in an ear after the wireless earphone is put on. Thus, tightness of an earphone in a wearing state can be detected with the barometric pressure sensor. When the wireless earphone is detected to be loosely worn, the wireless earphone can send prompt information to an electronic device coupled with the wireless earphone, to remind a user that the wireless earphone has a risk of falling off.

Hereinafter, embodiments of the present disclosure will be described in detail.

According to an embodiment of the disclosure, a method for controlling earphone switching is provided. The method is applicable to a first earphone and includes the following. Whether the first earphone is put in a charging case is detected, where the first earphone is coupled with a second earphone and an electronic device and serves as a master earphone, and the second earphone serves as a slave earphone. Upon detecting that the first earphone is put in the charging case, the first earphone is switched to serve as the slave earphone and the second earphone is switched to serve as the master earphone.

According to an embodiment of the disclosure, an earphone is provided. The earphone serves as a master earphone and is coupled with an electronic device and the other earphone serving as a slave earphone. The earphone includes at least one processor and a computer readable storage. The computer readable storage is coupled to the at least one processor and stores at least one computer executable instruction thereon which, when executed by the at least one processor, is operable with the at least one processor to: detect whether the earphone is put in a charging case; and switch the earphone to serve as the slave earphone and switch the other earphone to serve as the master earphone, upon detecting that the earphone is put in the charging case.

According to an embodiment of the disclosure, an earphone system is provided. The earphone system includes a first earphone and a second earphone with only one of them being capable of coupling with an electronic device at a time. The first earphone is currently coupled with the electronic device and the second earphone. The first earphone includes at least one processor and a computer readable storage. The computer readable storage is coupled to the at least one processor and stores at least one computer executable instruction thereon which, when executed by the at least one processor, is operable with the at least one processor to: detect whether the first earphone is put in a charging case; and disconnect a first data transmission link between the first earphone and the electronic device and establish a second data transmission link between the second earphone and the electronic device, upon detecting that the first earphone is put in the charging case.

Embodiments of the disclosure will be detailed below with reference to the accompanying drawings.

FIG. 1A is a schematic structural diagram illustrating a control apparatus according to an embodiment of the present disclosure. As illustrated in FIG. 1A, a control apparatus 100 includes a store-and-process circuit 110 and a sensor 170 coupled with the store-and-process circuit 110. The control apparatus 100 may be a wireless earphone or a charging case.

The control apparatus 100 can include a control circuit. The control circuit can include the store-and-process circuit 110. The store-and-process circuit 110 may be a memory, such as a hard drive memory, a non-transitory memory (such as a flash memory, other electronically programmable read-only memories used to form a solid-state drive, or the like), a transitory memory (such as a static random access memory, dynamic random access memory, or the like), or the like, which is not limited herein. The store-and-process circuit 110 has a processing circuit to control operations of the control apparatus 100. The processing circuit can be implemented based on one or more microprocessors, microcontrollers, digital controllers for controlling switching between master and slave earphones, baseband processors, power management units, audio codec chips, application-specific integrated circuits, display driver integrated circuits, or the like.

The store-and-process circuit 110 can be configured to run software of the control apparatus 100, such as an Internet browsing application, a voice over Internet protocol (VOIP) phone call application, an email application, a media playback application, an operating system function, and the like. The software may be used to perform some control operations, such as camera-based image collection, ambient light sensor-based ambient light measurements, proximity sensor-based proximity state measurements, information display function based on status indicators such as status indicator lamps of light-emitting diodes (LEDs), touch sensor-based touch event detection, functions associated with displaying information on multiple (e.g., layered) displays, operations associated with implementing wireless communication functions, operations associated with collecting and generating audio signals, control operations associated with collecting and processing button-press event data, and other functions of the control apparatus 100, which is not limited herein.

The control apparatus 100 can further include an input-output circuit 150. The input-output circuit 150 can be configured to achieve data input and data output of the control apparatus 100, that is, to allow the control apparatus 100 to receive data from an external device and also allow the control apparatus 100 to output data to an external device. The input-output circuit 150 can include a sensor 170. The sensor 170 can include an ambient light sensor, an optical or capacitive proximity sensor, a touch sensor (e.g., based on an optical touch sensor and/or a capacitive touch sensor, where the touch sensor may be a part of a touch display screen or may be used independently as a touch sensor structure), an acceleration sensor, a gravity sensor, and other sensors.

The input-output circuit 150 can further include one or more display devices, such as a display 130. The display 130 may include one or more of a liquid crystal display, an organic light emitting diode (OLED) display, an electronic ink display, a plasma display, displays based on other display technologies. As an example, the display 130 includes an array of touch sensors (i.e., the display device can be a touch display screen). The touch sensor may be a capacitive touch sensor formed by an array of transparent touch sensor electrodes (e.g., indium tin oxide (ITO) electrodes), or may be a touch sensor formed with other touch technologies, such as acoustic touch, pressure sensitive touch, resistance touch, optical touch, and the like, and embodiments of the present disclosure are not particularly restricted.

An audio assembly 140 of the control apparatus 100 is configured to provide the control apparatus 100 with audio input and output functions. The audio assembly 140 may include speakers, microphones, buzzers, tone generators, and other assemblies for generating and detecting sound.

A communication circuit 120 is configured to provide the control apparatus 100 with the ability to communicate with external devices. For instance, the communication circuit 120 includes analog/digital input-output interface circuits and wireless communication circuits based on radio frequency signals and/or optical signals. The wireless communication circuit of the communication circuit 120 may include a radio frequency transceiver circuit, a power amplifier circuit, a low-noise amplifier, a switch, a filter, and an antenna. As an example, the wireless communication circuit of the communication circuit 120 includes a circuit for supporting near field communication (NFC) by transmitting and receiving near field coupled electromagnetic signals. Specifically, the communication circuit 120 includes an NFC antenna and an NFC transceiver. As another example, the communication circuit 120 further includes transceivers and antennas for cellular telephone, transceiver circuits and antennas for wireless local area network, and the like.

The control apparatus 100 can further include a battery (not illustrated), a power management circuit (not illustrated), and other input-output units 160. The other input-output units 160 include but are not limited to buttons and other status indicators.

An instruction can be input by a user via the input-output circuit 150 to control operations of the control apparatus 100, and state information and other outputs can be received from the control apparatus 100 with the input-output circuit 150 outputting data.

Figure 1B:
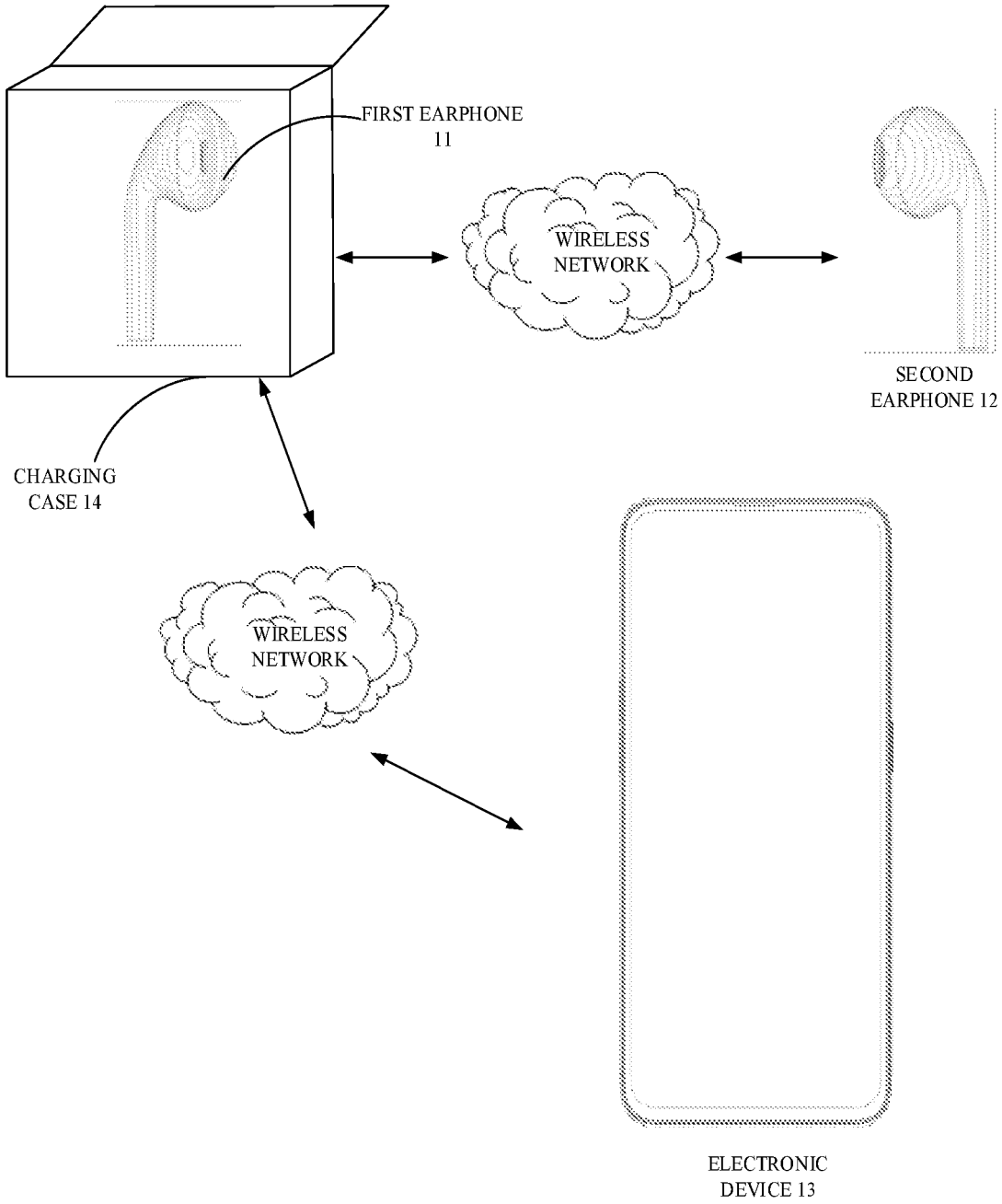
FIG. 1B is a schematic diagram illustrating a system network architecture for implementing a method for controlling earphone switching according to an embodiment of the present disclosure.

FIG. 1B is a schematic diagram illustrating a system network architecture for performing a method for controlling earphone switching according to an embodiment of the present disclosure. The system network architecture is an earphone system 10 for example. The control apparatus (e.g., a wireless earphone) illustrated in FIG. 1A is applicable to the system illustrated in FIG. 1B. The earphone system 10 includes to a first earphone 11, a second earphone 12, an electronic device 13, and a charging case 14. The first earphone 11 serves as the master earphone and the second earphone 12 serves as the slave earphone for example. The master earphone refers to an earphone that currently in communication with the electronic device 13 via a data transmission link established with the electronic device 13 for example, and the slave earphone refers to an earphone that does not currently in communication with the electronic device 13. At a time point, only one earphone can communicate with the electronic device 13 via the data transmission link established there between. In this embodiment, a first data transmission link is established between the first earphone 11 and an electronic device 13 via wireless network, and the wireless network can be Wi-Fi, Bluetooth, visible light communication, invisible light communication (infrared communication and ultraviolet communication), or the like. Based on the first data transmission link, data transmission (such as voice data, image data, video data, etc.) can be realized between the first earphone 11 and the electronic device 13. The first earphone 11 can be put in a charging case 14 and be coupled with the charging case 14, whereby communication between the first earphone 11 and the charging case 14 can be achieved or the first earphone 11 can be charged with the charging case 14. Also, the first earphone 11 and the second earphone 12 can communicate with each other via wireless network, and the wireless network can be Bluetooth, infrared, etc.

The earphone system 10 includes the first earphone 11 and the second earphone 12 with only one of them being capable of coupling with the electronic device 13 at a time. The term "first" and "second" are used herein to distinguish one earphone from another, however, the earphones are the same in terms of structure even though they play different roles in the system. Therefore, the first earphone 11 can be treated as the master phone and accordingly, the second earphone 12 can be treated as the slave earphone. The first earphone 11 is currently coupled with the electronic device 13 and the second earphone 12. That is, the first earphone 11 is treated as the master phone and accordingly, the second earphone 12 is treated as the slave earphone. The first earphone 11 includes at least one processor and a computer readable storage. The computer readable storage is coupled to the at least one processor and stores at least one computer executable instruction thereon which, when executed by the at least one processor, is operable with the at least one processor to: detect whether the first earphone 11 is put in a charging case; and disconnect a first data transmission link between the first earphone 11 and the electronic device 13 and establish a second data transmission link between the second earphone 12 and the electronic device 13, upon detecting that the first earphone 11 is put in the charging case.

It should be understood that implementation process will not be detailed herein and reference may be made to the following method implementations.

As such, switching between master and slave earphones can be achieved upon detecting that the master earphone is put in the charging case, which improves user experience.

Figure 1C:
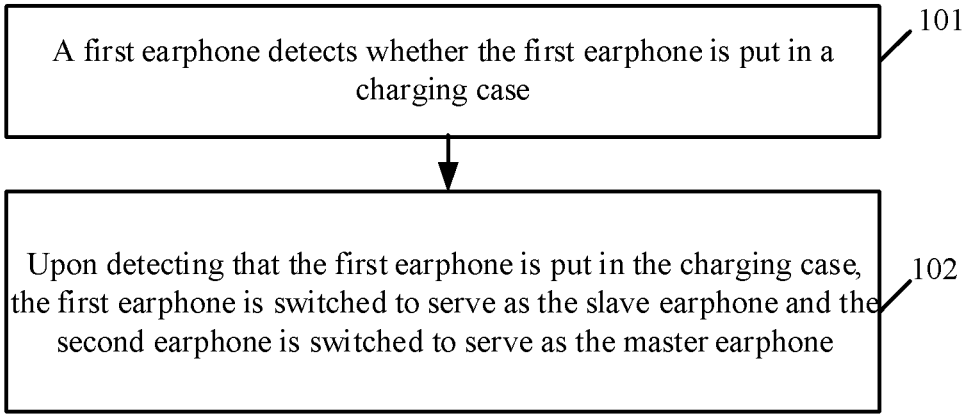
FIG. 1C is a schematic flowchart illustrating a method for controlling earphone switching according to an embodiment of the present disclosure.

FIG. 1C is a schematic flowchart illustrating a method for controlling earphone switching according to an embodiment of the present disclosure. The method is applicable to the control apparatus (e.g., a wireless earphone) illustrated in FIG. 1A and the system illustrated in FIG. 1B. As illustrated in FIG. 1C, the method includes the following.

At 101, a first earphone detects whether the first earphone is put in a charging case, where the first earphone is coupled with a second earphone and an electronic device and serving as a master earphone, and the second earphone serves as a slave earphone.

In this embodiment, the first earphone serves as the master earphone and the second earphone serves as the slave earphone. The first earphone and the second earphone have been paired successfully. The second earphone is not put in the charging case. The first earphone can detect whether the first earphone is put in the charging case. When the first earphone is in the charging case, the first earphone can be charged by the charging case. The expression of "detects whether the first earphone is put in the charging case" can be comprehended as detecting whether the first earphone is in the charging case or detecting whether the first earphone is coupled with the charging case, which is not limited herein.

At 102, upon detecting that the first earphone is put in the charging case, the first earphone is switched to serve as the slave earphone and the second earphone is switched to serve as the master earphone.

If the first earphone is in the charging case, the first earphone will be switched to serve as the slave earphone, and the second earphone will be switched to serve as the master earphone. Accordingly, the first earphone disconnects a first data transmission link with the electronic device and the second earphone establishes a second data transmission link with the electronic device. If the first earphone is not in the charging case, there is no need to perform subsequent operations of switching between master and slave earphones.

In an embodiment, the charging case includes a magnetic component. The first earphone detects whether the first earphone is put in the charging case at 101 as follows.

At A11, a force between the first earphone and the magnetic component is detected.

At A12, when the force is greater than a preset threshold, the first earphone is determined to be put in the charging case.

At A13, when the force is smaller than or equal to the preset threshold, the first earphone is determined not to be put in the charging case.

Figure 1D:
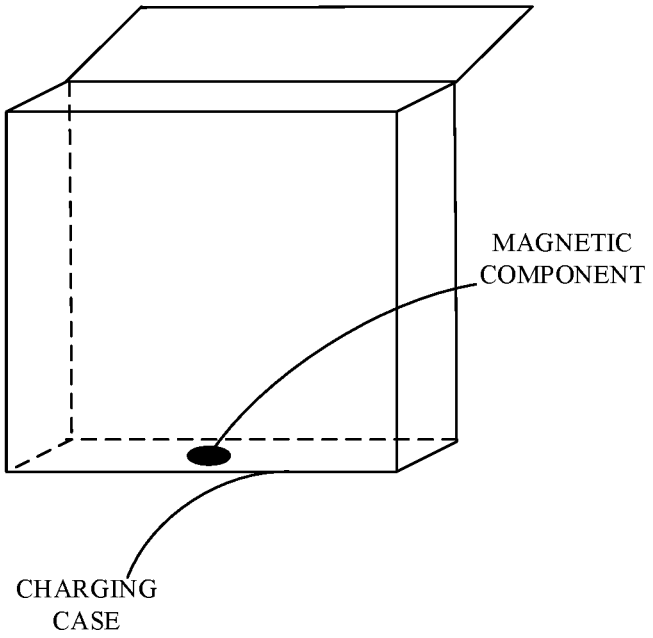
FIG. 1D is a schematic structural diagram illustrating a charging case according to an embodiment of the present disclosure.

As illustrated in FIG. 1D, the charging case is provided with the magnetic component. The preset threshold herein may be set by a user or by default. The force may be an attractive force or a repulsive force. The first earphone can detect the force between the first earphone and the magnetic component. When the force is greater than the preset threshold, determine that the first earphone is in the charging case. When the force is smaller than or equal to the preset threshold, determine that the first earphone is not in the charging case. As such, whether the first earphone is in the charging case can be determined by detecting the force. In embodiments of the disclosure, when the force is greater than the preset threshold, the first earphone may be in physical contact with the charging case, or may be suspended in the charging case.

In an embodiment, the first earphone detects whether the first earphone is put in the charging case at 101 as follows.

At A21, whether the first earphone is coupled with the charging case is detected.

At A22, upon detecting that the first earphone is coupled with the charging case, the first earphone is determined to be put in the charging case.

At A23, upon detecting that the first earphone is not coupled with the charging case, the first earphone is determined not to be put in the charging case.

In practice, the first earphone is put in the charging case mainly for charging the first earphone. If the first earphone needs to be charged, it is necessary to couple the charging case with the first earphone. On one hand, a power of the first earphone can be shown by the charging case. On the other hand, a communication connection between the first earphone and the electronic device can be indirectly achieved via the charging case. To this end, it is necessary to further determine whether the first earphone is coupled with the charging case. If the first earphone is coupled with the charging case, determine that the first earphone is in the charging case. If the first earphone is not coupled with the charging case, determine that the first earphone is not in the charging case.

In an example, the first earphone detects whether the first earphone is put in the charging case at 101 as follows.

At A31, whether the first earphone is being charged is detected.

At A32, upon detecting that the first earphone is being charged, the first earphone is determined to be put in the charging case.

At A33, upon detecting that the first earphone is not being charged, the first earphone is determined not to be put in the charging case.

The first earphone can detect whether itself is being charged. If the first earphone is being charged, determine that the first earphone is in the charging case. If the first earphone is not being charged, determine that the first earphone is not in the charging case.

In an embodiment, the first earphone is switched to serve as the slave earphone and the second earphone is switched to serve as the master earphone at 102 as follows.

A first data transmission link with the electronic device is disconnected, and a first request is sent to the second earphone to request the second earphone to establish a second data transmission link with the electronic device.

The first earphone can disconnect the first data transmission link with the electronic device and send the first request to the second earphone to request the second earphone to establish the second data transmission link with the electronic device.

In an embodiment, the first earphone is switched to serve as the slave earphone and the second earphone is switched to serve as the master earphone at 102 as follows.

A second request is sent to the electronic device to request the electronic device to establish a second data transmission link with the second earphone, and a first data transmission link with the electronic device is disconnected.

The first earphone can send the second request to the electronic device to request the electronic device to establish the second data transmission link with the second earphone, and can disconnect the first data transmission link with the electronic device after sending the second request.

In an embodiment, the first earphone is switched to serve as the slave earphone and the second earphone is switched to serve as the master earphone at 102 as follows.

A third request is sent to the electronic device to request the electronic device to disconnect a first data transmission link with the first earphone and establish a second data transmission link with the second earphone.

The first earphone can send the third request to the electronic device to request the electronic device to disconnect the first data transmission link with the first earphone and establish the second data transmission link with the second earphone.

In an embodiment, when the first earphone is put in the charging case, the method further includes the following.

An operating mode of the first earphone is detected. The operating mode includes a speaker mode and a non-speaker mode. When the operating mode is a non-speaker mode, the first earphone is switched to serve as the slave earphone and the second earphone is switched to serve as the master earphone.

The first earphone can detect the operating mode of the first earphone itself. When the operating mode is the non-speaker mode, the first earphone is switched to serve as the slave earphone and the second earphone is switched to serve as the master earphone. A volume of the first earphone is low in the non-speaker mode and sounds even lower when the first earphone is in the charging case. Once the master and slave earphones are switched, conversation can be conducted normally via the second earphone during a call. However, when the first earphone is in the speaker mode, operations of switching the first earphone to serve as the slave earphone and switching the second earphone to serve as the master earphone can be omitted.

As an example, when the master earphone is put in the charging case, a connection with a mobile phone will be disconnected. If the first earphone is in the non-speaker mode (that is, current volume is lower than the maximum volume of the first earphone), when the first earphone is detected to be in the charging case, the first earphone will send a switching notification to the second earphone and disconnect a first data transmission link with the mobile phone. Upon receiving the switching notification, the second earphone will establish a second data transmission link with the mobile phone. As such, the slave earphone that is not in the charging case can be configured to be coupled with the mobile phone to serve as the master earphone.

In an embodiment, when the first earphone is put in the charging case, the method further includes the following.

A volume of the first earphone is acquired. When the volume is lower than a preset volume, the first earphone is switched to serve as the slave earphone and the second earphone is switched to serve as the master earphone.

The preset volume herein can be set by a user or by default. The first earphone can acquire the volume of the first earphone, and switches the first earphone to serves as the slave earphone and switches the second earphone to serve as the master earphone when the volume is lower than the preset volume. The volume of the first earphone is limited and sounds even lower when the first earphone is in the charging case. Therefore, if master and slave earphones are switched, conversation can be conducted normally via the second earphone during a call. On the contrary, when the volume of the first earphone is higher than or equal to the preset volume, operations of switching the first earphone to serve as the slave earphone and switching the second earphone to serve the master earphone can be omitted.

In an example, when the first earphone is put in the charging case, the method further includes the following.

When an incoming call is received, identity information corresponding to the target incoming call is acquired. If the identity information satisfies a preset condition (for example, when the identity information is preset information), the first earphone is switched to serve as the slave earphone and the second earphone is switched to serve as the master earphone.

The identity information of the incoming call herein may include one or more of: phone number, identification information, location information, carrier information, and the like. As an example, "identification information" refers to information for labeling an incoming call, such as fraud, sale, insurance, etc. "Location information" mainly relates to a home location of the phone number. "Carrier information" relates to a carrier to which the phone number belongs.

The preset information (such as phone number, identification information, location information, carrier information, and the like) can be set by a user or by default. On the contrary, if the identity information is not the preset information, operations of switching the first earphone to serve as the slave earphone and switching the second earphone to serve as the master earphone can be omitted. In this way, harassment can be avoided to some extent, and frequency of switching between master and slave earphones can be decreased, and thus power consumption can be reduced.

According to the method for controlling earphone switching provided above, the first earphone detects whether the first earphone is put in the charging case. If the first earphone is put in the charging case, the first earphone is switched to serve as the slave earphone and the second earphone is switched to serve as the master earphone. As such, switching between master and slave earphones can be achieved upon detecting that the master earphone is put in the charging case, which improves user experience.

Figure 2:
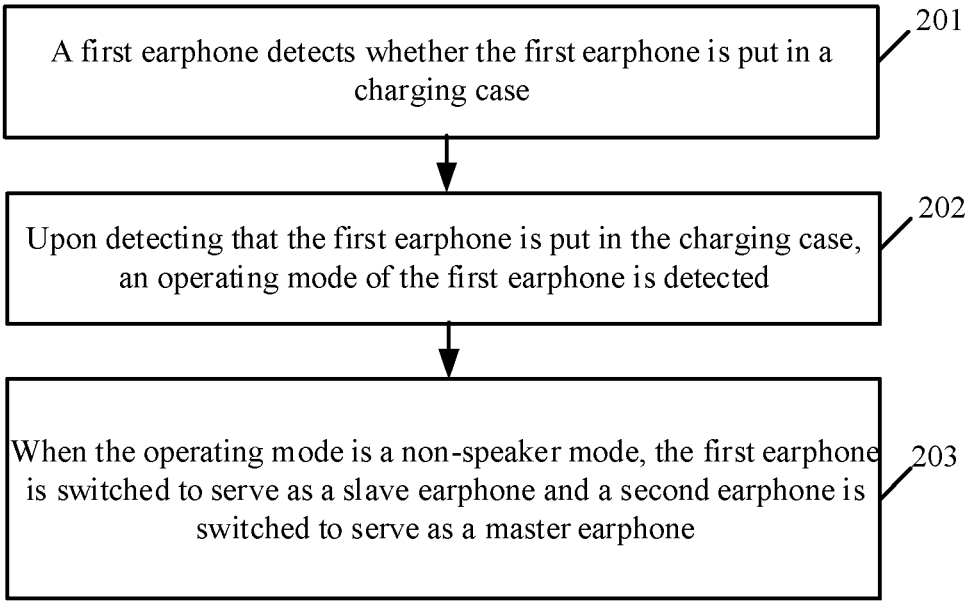
FIG. 2 is a schematic flowchart illustrating a method for controlling earphone switching according to another embodiment of the present disclosure.

Similar to the above embodiments, FIG. 2 is a schematic flowchart illustrating a method for controlling earphone switching according to another embodiment of the present disclosure. The method is applicable to the control apparatus (e.g., a wireless earphone) illustrated in FIG. 1A and the system illustrated in FIG. 1B. As illustrated in FIG. 2, the method includes the following.

At 201, a first earphone detects whether the first earphone is put in a charging case.

At 202, upon detecting that the first earphone is put in the charging case, an operating mode of the first earphone is detected.

At 203, when the operating mode is a non-speaker mode, the first earphone is switched to serve as a slave earphone and a second earphone is switched to serve as a master earphone.

According to the method for controlling earphone switching provided above, the first earphone detects whether the first earphone is put in the charging case. Upon detecting that the first earphone is put in the charging case, the operating mode of the first earphone is detected. When the operating mode is the non-speaker mode, the first earphone is switched to serve as the slave earphone and the second earphone is switched to serve as the master earphone. In this way, if the master earphone is in the charging case, when the operating mode of the first earphone is the non-speaker mode, switching between master and slave earphones can be achieved, which improves user experience.

Figure 3:
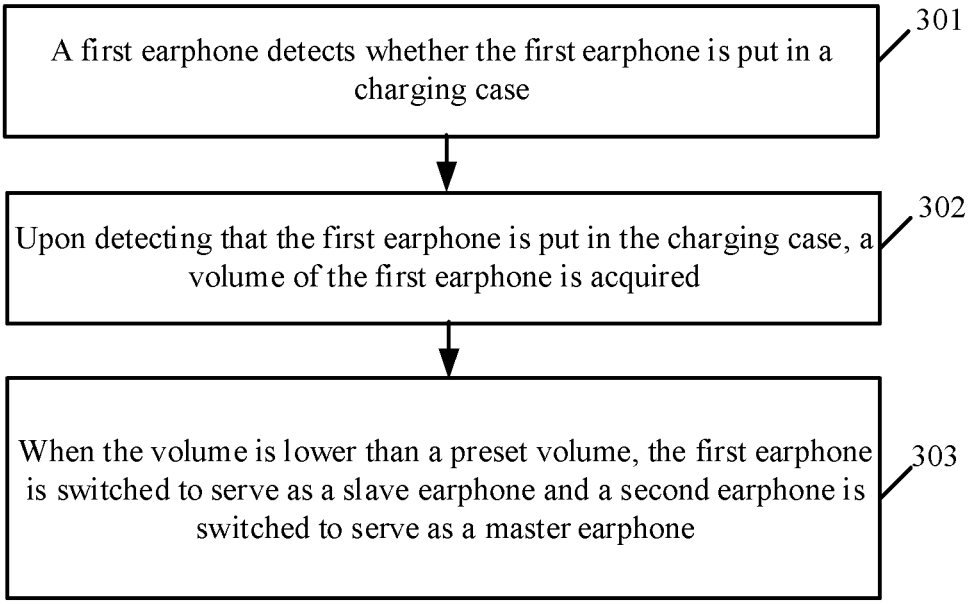
FIG. 3 is a schematic flowchart illustrating a method for controlling earphone switching according to another embodiment of the present disclosure.

Similar to the above embodiments, FIG. 3 is a schematic flowchart illustrating a method for controlling earphone switching according to another embodiment of the present disclosure. The method is applicable to the control apparatus (e.g., a wireless earphone) illustrated in FIG. 1A and the system illustrated in FIG. 1B. As illustrated in FIG. 3, the method includes the following.

At 301, a first earphone detects whether the first earphone is put in a charging case.

At 302, upon detecting that the first earphone is put in the charging case, a volume of the first earphone is acquired.

At 303, when the volume is lower than a preset volume, the first earphone is switched to serve as a slave earphone and a second earphone is switched to serve as a master earphone.

According to the method for controlling earphone switching provided above, the first earphone detects whether the first earphone is put in the charging case. Upon detecting that the first earphone is put in the charging case, the volume of the first earphone is acquired. When the volume is lower than the preset volume, the first earphone is switched to serve as the slave earphone and the second earphone is switched to serve as the master earphone. As such, if the master earphone is in the charging case, when the volume of the first earphone is low, switching between master and slave earphones can be achieved, and it is possible to improve user experience.

Figure 4:
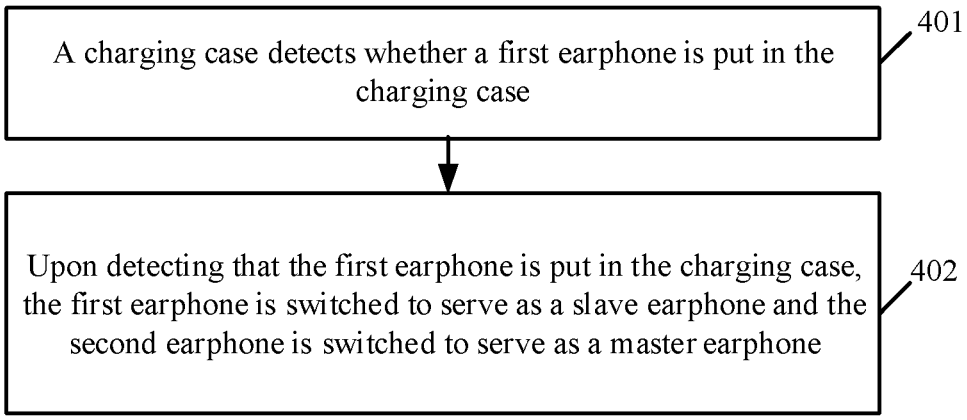
FIG. 4 is a schematic flowchart illustrating a method for controlling earphone switching according to another embodiment of the present disclosure.

Similar to the above embodiments, FIG. 4 is a schematic flowchart illustrating a method for controlling earphone switching according to another embodiment of the present disclosure. The method is applicable to the control apparatus (e.g., a charging case) and the system illustrated in FIG. 1B. As illustrated in FIG. 4, the method includes the following.

At 401, a charging case detects whether a first earphone is put in the charging case.

In this embodiment, the first earphone serves as a master earphone and a second earphone serves as a slave earphone. The first earphone and the second earphone have been paired successfully. The second earphone is not put in the charging case. The charging case can detect whether the first earphone is put in the charging case. Here, if the first earphone is in the charging case, the first earphone can be charged by the charging case. As will be appreciated, the expression of "detects whether the first earphone is put in the charging case" may refer to detecting whether the first earphone is in the charging case or detecting whether the first earphone is coupled with the charging case, which is not limited herein.

At 402, upon detecting that the first earphone is put in the charging case, the first earphone is switched to serve as a slave earphone and the second earphone is switched to serve as a master earphone.

If the first earphone is in the charging case, the charging case can switch the first earphone to serve as the slave earphone and switch the second earphone to serve as the master earphone.

In an example, the charging case includes a magnetic component. The charging case detects whether the first earphone is put in the charging case at 401 as follows.

At A11, a force between the first earphone and the magnetic component is detected.

At A12, when the force is greater than a preset threshold, the first earphone is determined to be put in the charging case.

At A13, when the force is smaller than or equal to the preset threshold, the first earphone is determined not to be put in the charging case.

As illustrated in FIG. 1D, the charging case is provided with the magnetic component. The preset threshold herein may be set by a user or by default. The force may be an attractive force or a repulsive force. The charging case can detect the force between the first earphone and the magnetic component. When the force is greater than the preset threshold, determine that the first earphone is in the charging case. When the force is smaller than or equal to the preset threshold, determine that the first earphone is not in the charging case. As such, whether the first earphone is in the charging case can be determined by detecting the force. In embodiments of the disclosure, when the force is greater than the preset threshold, the first earphone may be in physical contact with the charging case, or may be suspended in the charging case.

In an example, the charging case detects whether the first earphone is put in the charging case at 401 as follows.

At A21, whether the first earphone is coupled with the charging case is detected.

At A22, upon detecting that the first earphone is coupled with the charging case, the first earphone is determined to be put in the charging case.

At A23, upon detecting that the first earphone is not coupled with the charging case, the first earphone is determined not to be put in the charging case.

In practice, the first earphone is put in the charging case mainly for charging the first earphone. If the first earphone needs to be charged, a connection between the charging case and the first earphone will be established. On one hand, a power of the first earphone can be shown by the charging case. On the other hand, a communication connection between the first earphone and an electronic device can be indirectly achieved via the charging case. To this end, it is necessary to further determine whether the first earphone is coupled with the charging case. Upon determining that the first earphone is coupled with the charging case, determine that the first earphone is in the charging case. Upon determining that the first earphone is not coupled with the charging case, determine that the first earphone is not in the charging case.

In an example, the charging case detects whether the first earphone is put in the charging case at 401 as follows.

At A31, whether the first earphone is being charged is detected.

At A32, upon detecting that the first earphone is being charged, the first earphone is determined to be put in the charging case.

At A33, upon detecting that the first earphone is not being charged, the first earphone is determined not to be put in the charging case.

The charging case can detect whether the first earphone is being charged. If the first earphone is being charged, determine that the first earphone is in the charging case. If the first earphone is not being charged, determine that the first earphone is not in the charging case.

In an embodiment, the charging case is coupled with an electronic device, and the first earphone is switched to serve as the slave earphone and the second earphone is switched to serve as the master earphone at 402 as follows.

A fourth request is sent to the electronic device to request the electronic device to disconnect a first data transmission link with the first earphone and establish a second data transmission link with the second earphone.

In this embodiment, when the electronic device is coupled with the charging case, the charging case can send the fourth request to the electronic device to request the electronic device to disconnect the first data transmission link with the first earphone and establish the second data transmission link with the second earphone.

In an embodiment, the charging case is coupled with the first earphone, and the first earphone is switched to serve as the slave earphone and the second earphone is switched to serve as the master earphone at 402 as follows.

A fifth request and a sixth request are sent to the first earphone. The fifth request is used for requesting the first earphone to disconnect a first data transmission link with an electronic device and forward the sixth request to the second earphone. The sixth request is used for requesting the second earphone to establish a second data transmission link with the electronic device.

In this embodiment, when the charging case is coupled with the first earphone, the charging case can send the fifth request and the sixth request to the first earphone. The fifth request is used for requesting the first earphone to disconnect the first data transmission link with the electronic device and forward the sixth request to the second earphone. The second earphone can establish the second data transmission link with the electronic device according to the sixth request.

According to the method for controlling earphone switching provided above, the charging case detects whether the first earphone is put in the charging case. When the first earphone is put in the charging case, the first earphone is switched to serve as the slave earphone and the second earphone is switched to serve as the master earphone. As such, when the master earphone is in the charging case, switching between master and slave earphones can be achieved, which improves user experience.

Figure 5:
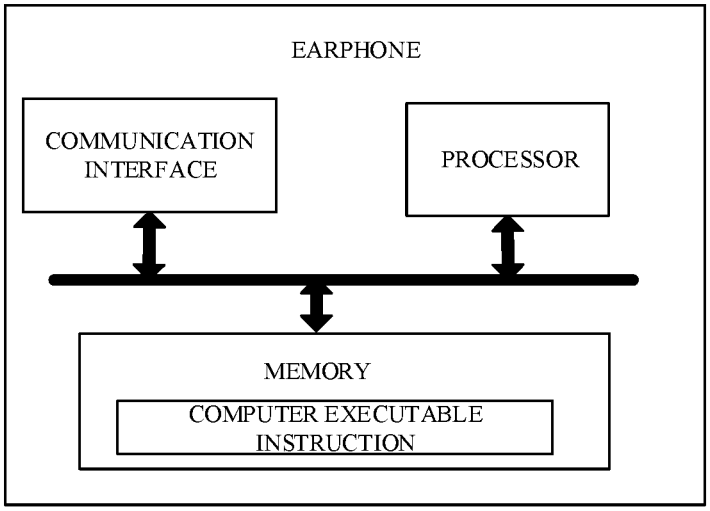
FIG. 5 is a schematic structural diagram illustrating an earphone according to an embodiment of the present disclosure.

FIG. 5 is a schematic structural diagram illustrating an earphone according to an embodiment of the present disclosure. The earphone serves as a master earphone and is coupled with an electronic device and the other earphone serving as a slave earphone. As illustrated in FIG. 5, the earphone includes at least one processor, a computer readable storage (e.g., a memory), and a communication interface. The earphone is a first earphone for example and is applicable to the system illustrated in FIG. 1B. The computer readable storage is coupled to the at least one processor and stores at least one computer executable instruction thereon which, when executed by the at least one processor, is operable with the at least one processor to: detect whether the first earphone is put in a charging case, and switch the first earphone to serve as a slave earphone and switch a second earphone to serve as a master earphone upon detecting that the first earphone is put in the charging case.

With aid of the control apparatus provided herein, whether the first earphone is put in the charging case is detected. Upon detecting that the first earphone is put in the charging case, the first earphone is switched to serve as the slave earphone and the second earphone is switched to serve as the master earphone. As such, switching between master and slave earphones can be achieved in the case of detecting that the master earphone is put in the charging case, thereby improving user experience.

In an example, in terms of switching the first earphone to serve as the slave earphone and switching the second earphone to serve as the master earphone, the one or more programs include instructions operable with the processor to: disconnect a first data transmission link with an electronic device, and send a first request to the second earphone to request the second earphone to establish a second data transmission link with the electronic device.

In an example, in terms of switching the first earphone to serve as the slave earphone and switching the second earphone to serve as the master earphone, the one or more programs include instructions operable with the processor to: send a second request to an electronic device to request the electronic device to establish a second data transmission link with the second earphone, and disconnect a first data transmission link with the electronic device.

In an example, in terms of switching the first earphone to serve as the slave earphone and switching the second earphone to serve as the master earphone, the one or more programs include instructions operable with the processor to: send a third request to an electronic device to request the electronic device to disconnect a first data transmission link with the first earphone and establish a second data transmission link with the second earphone.

In an example, the charging case includes a magnetic component. In terms of detecting whether the first earphone is put in the charging case, the one or more programs include instructions operable with the processor to: detect a force between the first earphone and the magnetic component, determine that the first earphone is put in the charging case when the force is greater than a preset threshold, and determine that the first earphone is not put in the charging case when the force is smaller than or equal to the preset threshold.

In an example, in terms of detecting whether the first earphone is put in the charging case, the one or more programs include instructions operable with the processor to: detect whether the first earphone is coupled with the charging case, determine that the first earphone is put in the charging case upon detecting that the first earphone is coupled with the charging case, and determine that the first earphone is not put in the charging case upon detecting that the first earphone is not coupled with the charging case.

In an example, the one or more programs further include instructions operable with the processor to: detect an operating mode of the first earphone, and switch the first earphone to serve as the slave earphone and switch the second earphone to serve as the master earphone when the operating mode is a non-speaker mode.

In an example, the one or more programs further include instructions operable with the processor to: acquire a volume of the first earphone, and switch the first earphone to serve as the slave earphone and switch the second earphone to serve as the master earphone when the volume is lower than a preset volume.

In an example, the one or more programs further include instructions operable with the processor to: receive an incoming call; acquire identity information corresponding to the incoming call, and switch the first earphone to serve as the slave earphone and switch the second earphone to serve as the master earphone when the identity information satisfies a preset condition (e.g., when the identity information is preset information).

The foregoing technical solutions of embodiments of the disclosure are mainly described from a perspective of execution of the method. It can be understood that, in order to implement the above functions, the control apparatus includes hardware structures and/or software modules for performing respective functions. Those of ordinary skill in the art will appreciate that units and algorithmic operations of various examples described in connection with embodiments herein can be implemented in hardware or a combination of computer software and hardware. Whether these functions are implemented by means of hardware or computer software driving hardware depends on the particular application and the design constraints of the associated technical solution. For a specific application, those skilled in the art may use different methods to implement the described functionality, but such embodiment should not be regarded as beyond the scope of the disclosure.

In embodiments of the present disclosure, the control apparatus can be divided into different functional units according to the above method embodiments. For example, the control apparatus can be divided into different functional units corresponding to each function, or two or more functions may be integrated into one processing unit. The integrated unit can take the form of hardware or a software functional unit. It is to be noted that, division of units provided herein is illustrative and is just a logical function division. In practice, there can be other manners of division.

Figure 6:
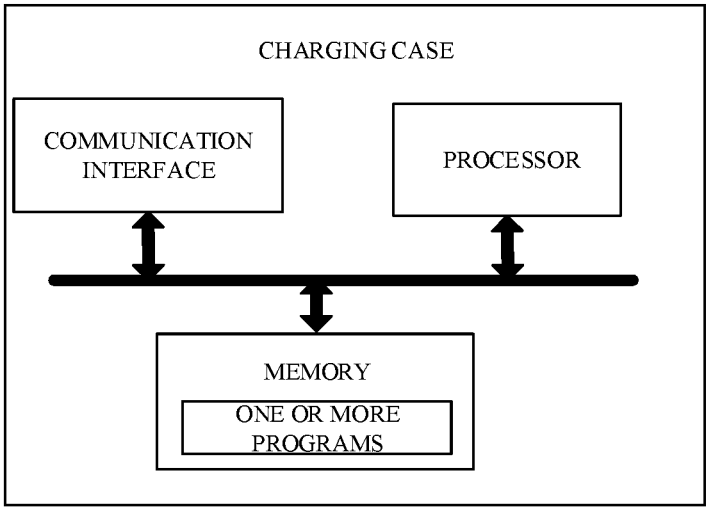
FIG. 6 is a schematic structural diagram illustrating a charging case according to another embodiment of the present disclosure.

FIG. 6 is a schematic structural diagram illustrating a charging case according to another embodiment of the present disclosure. As illustrated in FIG. 6, the charging case includes a processor, a memory, a communication interface, and one or more programs stored in the memory and configured to be executed by the processor. The charging case is applicable to the system illustrated in FIG. 1B. The one or more programs include instructions operable with the processor to: detect whether a first earphone is put in the charging case, and switch the first earphone to serve as a slave earphone and switch a second earphone to serve as a master earphone upon detecting that the first earphone is put in the charging case.

With aid of the charging case provided herein, whether the first earphone is put in the charging case is detected. Upon detecting that the first earphone is put in the charging case, the first earphone is switched to serve as the slave earphone and the second earphone is switched to serve as the master earphone. In this way, when the master earphone is in the charging case, switching between master and slave earphones can be achieved, which is possible to improve user experience.

In an example, the charging case is coupled with an electronic device. In terms of switching the first earphone to serve as the slave earphone and switching the second earphone to serve as the master earphone, the one or more programs include instructions operable with the processor to: send a fourth request to the electronic device to request the electronic device to disconnect a first data transmission link with the first earphone and establish a second data transmission link with the second earphone.

In an example, the charging case is coupled with the first earphone. In terms of switching the first earphone to serve as the slave earphone and switching the second earphone to serve as the master earphone, the one or more programs include instructions operable with the processor to: send a fifth request and a sixth request to the first earphone, where the fifth request is used for requesting the first earphone to disconnect a first data transmission link with an electronic device and forward the sixth request to the second earphone, and the sixth request is used for requesting the second earphone to establish a second data transmission link with the electronic device.

Figure 7A:
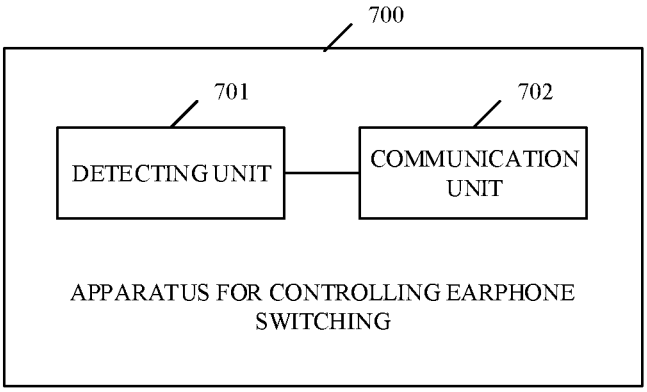
FIG. 7A is a schematic structural diagram illustrating an apparatus for controlling earphone switching according to an embodiment of the present disclosure.

FIG. 7A is a schematic structural diagram illustrating an apparatus 700 for controlling earphone switching according to an embodiment of the present disclosure. The apparatus 700 is applicable to a wireless earphone and the system illustrated in FIG. 1B. As illustrated in FIG. 7A, the apparatus 700 includes a detecting unit 701 and a communication unit 702. The detecting unit 701 is configured to detect whether a first earphone is put in a charging case. When the detecting unit 701 detects that the first earphone is put in the charging case, the communication unit 702 is configured to switch the first earphone to serve as a slave earphone and switch a second earphone to serve as a master earphone.

The apparatus for controlling earphone switching is applicable to the first earphone. The detecting unit 701 detects whether the first earphone is put in the charging case. When the detecting unit 701 detects that the first earphone is put in the charging case, the communication unit 702 switches the first earphone to serve as the slave earphone and switches the second earphone to serve as the master earphone. In this way, when the master earphone is in the charging case, switching between master and slave earphones can be achieved, thus improving user experience.

In an example, for switching the first earphone to serve as the slave earphone and switching the second earphone to serve as the master earphone, the communication unit 702 is configured to: disconnect a first data transmission link with an electronic device, and send a first request to the second earphone to request the second earphone to establish a second data transmission link with the electronic device.

In an example, for switching the first earphone to serve as the slave earphone and switching the second earphone to serve as the master earphone, the communication unit 702 is configured to: send a second request to an electronic device to request the electronic device to establish a second data transmission link with the second earphone, and disconnect a first data transmission link with the electronic device.

In an example, for switching the first earphone to serve as the slave earphone and switching the second earphone to serve as the master earphone, the communication unit 702 is configured to: send a third request to an electronic device to request the electronic device to disconnect a first data transmission link with the first earphone and establish a second data transmission link with the second earphone.

In an example, the charging case includes a magnetic component. For detecting whether the first earphone is put in the charging case, the detecting unit 701 is configured to: detect a force between the first earphone and the magnetic component, determine that the first earphone is put in the charging case when the force is greater than a preset threshold, and determine that the first earphone is not put in the charging case when the force is smaller than or equal to the preset threshold.

In an example, for detecting whether the first earphone is put in the charging case, the detecting unit 701 is configured to: detect whether the first earphone is coupled with the charging case, determine that the first earphone is put in the charging case upon detecting that the first earphone is coupled with the charging case, and determine that the first earphone is not put in the charging case upon detecting that the first earphone is not coupled with the charging case.

In an example, the detecting unit 701 is further configured to: detect an operating mode of the first earphone. When the operating mode is a non-speaker mode, the communication unit 702 is configured to switch the first earphone to serve as the slave earphone and switch the second earphone to serve as the master earphone.

Figure 7B:
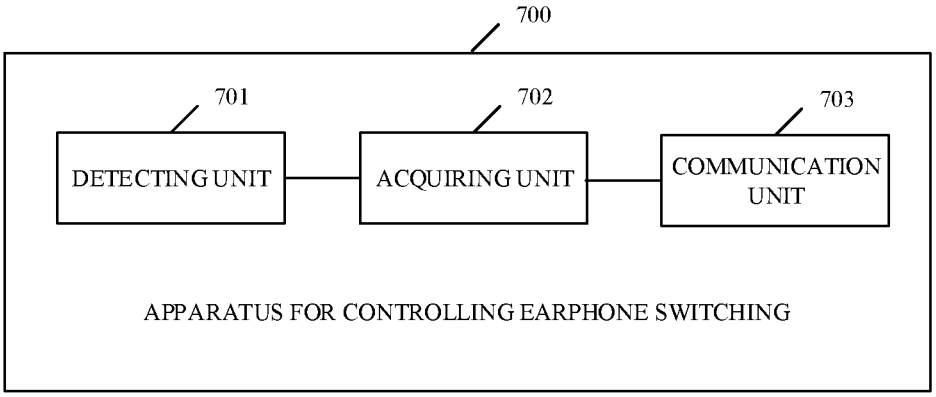
FIG. 7B is a schematic structural diagram illustrating an apparatus for controlling earphone switching according to another embodiment of the present disclosure.

In an example, FIG. 7B illustrates a modification of the apparatus for controlling earphone switching illustrated in FIG. 7A. As illustrated in FIG. 7B, compared with the apparatus illustrated in FIG. 7A, an apparatus illustrated in FIG. 7B further includes an acquiring unit 703. The acquiring unit 703 is configured to acquire a volume of the first earphone. When the volume is lower than a preset volume, the communication unit 702 is configured to switch the first earphone to serve as the slave earphone and switch the second earphone to serve as the master earphone.

Figure 7C:
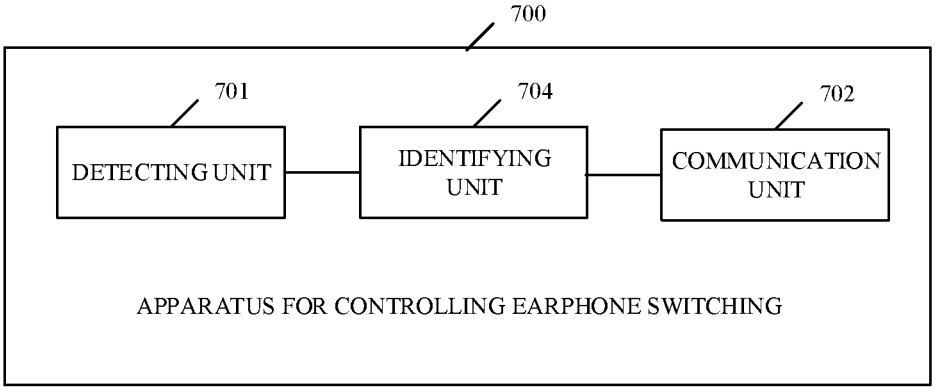
FIG. 7C is a schematic structural diagram illustrating an apparatus for controlling earphone switching according to another embodiment of the present disclosure.

In an example, FIG. 7C illustrates another modification of the apparatus for controlling switching between master and slave earphones illustrated in FIG. 7A. As illustrated in FIG. 7C, compared with the apparatus illustrated in FIG. 7A, an apparatus illustrated in FIG. 7C further includes an identifying unit 704. The identifying unit 704 is configured to acquire identity information corresponding to a target incoming call when the target incoming call is monitored. When the identity information is preset information, the communication unit 702 is configured to switch the first earphone to serve as the slave earphone and switch the second earphone to serve as the master earphone.

Figure 8:
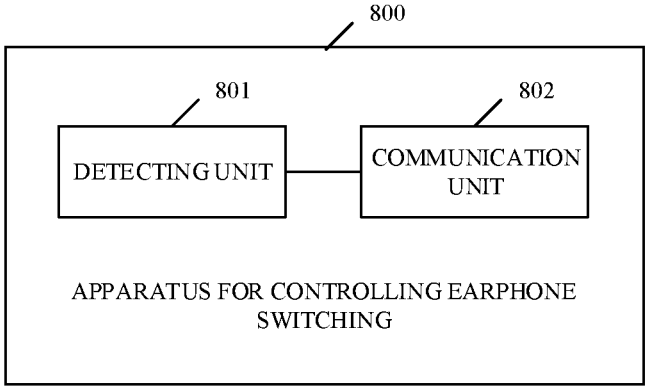
FIG. 8 is a schematic structural diagram illustrating an apparatus for controlling earphone switching according to another embodiment of the present disclosure.

FIG. 8 is a schematic structural diagram illustrating an apparatus 800 for controlling earphone switching according to another embodiment of the present disclosure. The apparatus 800 is applicable to a charging case and the system illustrated in FIG. 1B. As illustrated in FIG. 8, the apparatus 800 includes a detecting unit 801 and a communication unit 802. The detecting unit 801 is configured to detect whether a first earphone is put in the charging case. When the detecting unit 801 detects that the first earphone is put in the charging case, the communication unit 802 is configured to switch the first earphone to serve as a slave earphone and switch a second earphone to serve as a master earphone.

The apparatus for controlling earphone switching provided herein is applicable to the charging case. The detecting unit 801 detects whether the first earphone is put in the charging case. When the detecting unit 801 detects that the first earphone is put in the charging case, the communication unit 802 switches the first earphone to serve as the slave earphone and switches the second earphone to serve as the master earphone. As such, when the master earphone is in the charging case, switching between master and slave earphones can be achieved, thereby improving user experience.

In an example, the charging case is coupled with an electronic device. For switching the first earphone to serve as the slave earphone and switching the second earphone to serve as the master earphone, the communication unit 802 is configured to: send a fourth request to the electronic device to request the electronic device to disconnect a first data transmission link with the first earphone and establish a second data transmission link with the second earphone.

In an example, the charging case is coupled with the first earphone. For switching the first earphone to serve as the slave earphone and switching the second earphone to serve as the master earphone, the communication unit 802 is configured to: send a fifth request and a sixth request to the first earphone, where the fifth request is used for requesting the first earphone to disconnect a first data transmission link with an electronic device and forward the sixth request to the second earphone, and the sixth request is used for requesting the second earphone to establish a second data transmission link with the electronic device.

According to embodiments of the disclosure, a computer storage medium is further provided. The computer storage medium is configured to store computer programs for electronic data interchange. The computer programs are operable with a computer to perform all or part of the operations of any of the methods described in the foregoing method embodiments.

According to embodiments of the present disclosure, a computer program product is further provided. The computer program product includes a non-transitory computer readable storage medium configured to store computer programs. The computer programs are operable with a computer to perform all or part of the operations of any of the methods described in the foregoing method embodiments. The computer program product may be a software installation package.

It is to be noted that, for the sake of simplicity, the foregoing method embodiments are described as a series of action combinations. However, it will be appreciated by those skilled in the art that the present disclosure is not limited by the sequence of actions described. The reason is that, according to the present disclosure, certain steps or operations may be executed in other orders or simultaneously. Besides, it will be appreciated by those skilled in the art that the embodiments described in the specification are exemplary embodiments and the actions and modules involved are not necessarily essential to the present disclosure.

In the foregoing embodiments, the description of each embodiment has its own emphasis. For the parts not described in detail in one embodiment, reference may be made to related descriptions in other embodiments.

In the embodiments of the disclosure, the apparatus disclosed in embodiments provided herein may be implemented in other manners. For example, the device/apparatus embodiments described above are merely illustrative; for instance, the division of the unit is only a logical function division and there can be other manners of division during actual embodiments, for example, multiple units or assemblies may be combined or may be integrated into another system, or some features may be ignored or not performed. In addition, coupling or communication connection between each illustrated or discussed component may be direct coupling or communication connection, or may be indirect coupling or communication among devices or units via some interfaces, and may be electrical connection, or other forms of connection.

The units described as separate components may or may not be physically separated, the components illustrated as units may or may not be physical units, that is, they may be in the same place or may be distributed to multiple network elements. All or part of the units may be selected according to actual needs to achieve the purpose of the technical solutions of the embodiments.

In addition, the functional units in various embodiments of the present disclosure may be integrated into one processing unit, or each unit may be physically present, or two or more units may be integrated into one unit. The above-mentioned integrated unit can be implemented in the form of hardware or a software function unit.

The integrated unit may be stored in a computer-readable memory when it is implemented in the form of a software functional unit and is sold or used as a separate product. Based on such understanding, the technical solutions of the present disclosure essentially, or the part of the technical solutions that contributes to the related art, or all or part of the technical solutions, may be embodied in the form of a software product which is stored in a memory and includes instructions for causing a computer device (which may be a personal computer, a server, or a network device, and so on) to perform all or part of the steps described in the various embodiments of the present disclosure. The memory includes various medium capable of storing program codes, such as a universal serial bus (USB) flash disk, a read-only memory (ROM), a random-access memory (RAM), a removable hard disk, a magnetic disk, a compact disc (CD), or the like.

It will be understood by those of ordinary skill in the art that all or part of the steps of the various methods of the embodiments described above may be accomplished by means of a program to instruct associated hardware, and the program may be stored in a computer-readable memory, which may include a flash memory, a ROM, a RAM, a magnetic disk, or a CD, and so on.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law

What is claimed is:

1. A method for controlling earphone switching, being applicable to a first earphone and comprising:

detecting whether the first earphone is put in a charging case, the first earphone being coupled with a second earphone and an electronic device and serving as a master earphone, and the second earphone serving as a slave earphone;

switching the first earphone to serve as the slave earphone and switching the second earphone to serve as the master earphone, upon detecting that the first earphone is put in the charging case; and wherein the charging case comprises a magnetic component, and detecting whether the first earphone is put in the charging case comprises:

detecting a force between the first earphone and the magnetic component;

determining that the first earphone is put in the charging case, when the force is greater than a preset threshold; and determining that the first earphone is not put in the charging case, when the force is less than or equal to the preset threshold.

2. The method of claim 1, wherein switching the first earphone to serve as the slave earphone and switching the second earphone to serve as the master earphone comprises:

disconnecting a first data transmission link with the electronic device; and sending a request to the second earphone to request the second earphone to establish a second data transmission link with the electronic device.

3. The method of claim 1, wherein switching the first earphone to serve as the slave earphone and switching the second earphone to serve as the master earphone comprises:

sending a request to the electronic device to request the electronic device to establish a second data transmission link with the second earphone; and disconnecting a first data transmission link with the electronic device.

4. The method of claim 1, wherein switching the first earphone to serve as the slave earphone and switching the second earphone to serve as the master earphone comprises:

sending a request to the electronic device to request the electronic device to disconnect a first data transmission link with the first earphone and establish a second data transmission link with the second earphone.

5. The method of claim 1, wherein switching the first earphone to serve as the slave earphone and switching the second earphone to serve as the master earphone comprises:

detecting an operating mode of the first earphone; and switching the first earphone to serve as the slave earphone and switching the second earphone to serve as the master earphone, when the operating mode is a non-speaker mode.

6. The method of claim 1, wherein switching the first earphone to serve as the slave earphone and switching the second earphone to serve as the master earphone comprises:

acquiring a volume of the first earphone; and switching the first earphone to serve as the slave earphone and switching the second earphone to serve as the master earphone, when the volume is lower than a preset volume.

7. The method of claim 1, wherein switching the first earphone to serve as the slave earphone and switching the second earphone to serve as the master earphone comprises:

receiving an incoming call;

acquiring identity information of the incoming call; and switching the first earphone to serve as the slave earphone and switching the second earphone to serve as the master earphone, when the identity information satisfies a preset condition.

8. An earphone, serving as a master earphone and being coupled with an electronic device and the other earphone serving as a slave earphone, and comprising:

at least one processor; and a computer readable storage, coupled to the at least one processor and storing at least one computer executable instruction thereon which, when executed by the at least one processor, is operable with the at least one processor to:

detect a force between the earphone and a magnetic component;

determine that the earphone is put in a charging case, when the force is greater than a preset threshold;

determine that the earphone is not put in the charging case, when the force is less than or equal to the preset threshold; and switch the earphone to serve as the slave earphone and switch the other earphone to serve as the master earphone, upon detecting that the earphone is put in the charging case.

9. The earphone of claim 8, wherein the at least one computer executable instruction operable with the at least one processor to switch the earphone to serve as the slave earphone and switch the other earphone to serve as the master earphone is operable with the at least one processor to:

disconnect a first data transmission link with the electronic device; and send a request to the other earphone to request the other earphone to establish a second data transmission link with the electronic device.

10. The earphone of claim 8, wherein the at least one computer executable instruction operable with the at least one processor to switch the earphone to serve as the slave earphone and switch the other earphone to serve as the master earphone is operable with the at least one processor to:

send a request to the electronic device to request the electronic device to establish a second data transmission link with the other earphone; and disconnect a first data transmission link with the electronic device.

11. The earphone of claim 8, wherein the at least one computer executable instruction operable with the at least one processor to switch the earphone to serve as the slave earphone and switch the other earphone to serve as the master earphone is operable with the at least one processor to:

send a request to the electronic device to request the electronic device to disconnect a first data transmission link with the earphone and establish a second data transmission link with the other earphone.

12. The earphone of claim 8, wherein the at least one computer executable instruction operable with the at least one processor to switch the earphone to serve as the slave earphone and switch the other earphone to serve as the master earphone is operable with the at least one processor to:

detect an operating mode of the earphone; and switch the earphone to serve as the slave earphone and switch the other earphone to serve as the master earphone, when the operating mode is a non-speaker mode.

13. The earphone of claim 8, wherein the at least one computer executable instruction operable with the at least one processor to switch the earphone to serve as the slave earphone and switch the other earphone to serve as the master earphone is operable with the at least one processor to:

acquire a volume of the earphone; and switch the earphone to serve as the slave earphone and switch the other earphone to serve as the master earphone, when the volume is lower than a preset volume.

14. The earphone of claim 8, wherein the at least one computer executable instruction operable with the at least one processor to switch the earphone to serve as the slave earphone and switch the other earphone to serve as the master earphone is operable with the at least one processor to:

receive an incoming call;

acquire identity information of the incoming call; and switch the earphone to serve as the slave earphone and switch the other earphone to serve as the master earphone, when the identity information satisfies a preset condition.

15. An earphone system, comprising a first earphone and a second earphone with only one of them being capable of coupling with an electronic device at a time, the first earphone being currently coupled with the electronic device and the second earphone and comprising:

at least one processor; and a computer readable storage, coupled to the at least one processor and storing at least one computer executable instruction thereon which, when executed by the at least one processor, is operable with the at least one processor to:

detect a force between the first earphone and a magnetic component determine that the first earphone is put in a charging case, when the force is greater than a preset threshold;

determine that the first earphone is not put in the charging case, when the force is less than or equal to the preset threshold; and disconnect a first data transmission link between the first earphone and the electronic device and establish a second data transmission link between the second earphone and the electronic device, upon detecting that the first earphone is put in the charging case.

16. The earphone system of claim 15, wherein the first data transmission link is disconnected and the second data transmission link is established when at least one of the following is satisfied:

the first earphone is in a non-speaker mode;

a volume of the first earphone is lower than a preset volume; and an incoming call is received, which has predefined kind of identity information.

17. The earphone system of claim 15, wherein the at least one computer executable instruction operable with the at least one processor to disconnect the first data transmission link between the first earphone and the electronic device and establish the second data transmission link between the second earphone and the electronic device is operable with the at least one processor to:

disconnect, with the first earphone, the first data transmission link with the electronic device; and send, with the first earphone, a request to the second earphone to request the second earphone to establish the second data transmission link with the electronic device.

18. The earphone system of claim 15, wherein the at least one computer executable instruction operable with the at least one processor to disconnect the first data transmission link between the first earphone and the electronic device and establish the second data transmission link between the second earphone and the electronic device is operable with the at least one processor to:

send, with the first earphone, a request to the electronic device to request the electronic device to establish the second data transmission link with the second earphone; and disconnect, with the first earphone, the first data transmission link with the electronic device.

19. The earphone system of claim 15, wherein the at least one computer executable instruction operable with the at least one processor to disconnect the first data transmission link between the first earphone and the electronic device and establish the second data transmission link between the second earphone and the electronic device is operable with the at least one processor to:

send, with the first earphone, a request to the electronic device to request the electronic device to disconnect the first data transmission link with the first earphone and establish the second data transmission link with the second earphone.

* * * * *